US007988823B2

(12) United States Patent
Burazin et al.

(10) Patent No.: US 7,988,823 B2
(45) **Date of Patent: *Aug. 2, 2011**

(54) METHOD OF MAKING TEXTURED TISSUE SHEETS HAVING HIGHLIGHTED DESIGNS

(75) Inventors: Mark Alan Burazin, Oshkosh, WI (US); Cristina Asensio Mullally, Neenah, WI (US); Andrew Peter Bakken, Appleton, WI (US); Robert Eugene Krautkramer, Combined Locks, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/606,273

(22) Filed: Oct. 27, 2009

(65) Prior Publication Data

US 2010/0038044 A1 Feb. 18, 2010

Related U.S. Application Data

(62) Division of application No. 11/021,149, filed on Dec. 23, 2004, now Pat. No. 7,624,765.

(51) Int. Cl.
*D21F 11/00* (2006.01)
*B31F 1/07* (2006.01)

(52) U.S. Cl. ..... 162/109; 162/110; 162/117; 162/201; 162/204

(58) Field of Classification Search ..... 162/109–110, 162/117, 201, 204, 116, 134, 140, 348, 358.1–358.2, 162/900–904, 296, 362; 442/239, 268, 295, 442/203–205, 181; 264/70; 139/383 R, 139/383 A, 383 B
See application file for complete search history.

(56) References Cited

U.S. PATENT DOCUMENTS

| | | | | |
|---|---|---|---|---|
| 2,121,909 | A | 6/1938 | Fonda | |
| 3,423,266 | A | 1/1969 | Davies et al. | |
| 3,595,731 | A | 7/1971 | Davies et al. | |
| 4,068,036 | A | 1/1978 | Stanistreet | |
| RE30,955 | E | 6/1982 | Stanistreet | |
| 5,429,686 | A | 7/1995 | Chiu et al. | |
| 5,549,790 | A | 8/1996 | Van Phan | |
| 5,609,725 | A | 3/1997 | Van Phan | |
| 5,672,248 | A | 9/1997 | Wendt et al. | |
| 5,804,036 | A | 9/1998 | Phan et al. | |
| D427,472 | S | 7/2000 | Rogers et al. | |
| 6,136,146 | A | 10/2000 | Phan et al. | |
| 6,203,663 | B1 | 3/2001 | Kamps et al. | |
| 6,398,910 | B1 | 6/2002 | Burazin et al. | |
| 6,464,831 | B1 | 10/2002 | Trokhan et al. | |
| D465,094 | S | 11/2002 | Kuehn et al. | |
| 6,554,959 | B2 | 4/2003 | Von Paleske et al. | |
| 6,620,293 | B2 | 9/2003 | Sears et al. | |
| 6,779,683 | B2 | 8/2004 | Taylor et al. | |
| 6,787,000 | B2 | 9/2004 | Burazin et al. | |
| 6,821,385 | B2 | 11/2004 | Burazin et al. | |
| 6,841,037 | B2 | 1/2005 | Scherb et al. | |
| 6,991,846 | B2 | 1/2006 | Mallol et al. | |
| 7,070,678 | B2 | 7/2006 | Allen et al. | |
| 7,141,142 | B2 | 11/2006 | Burazin et al. | |
| 7,624,765 | B2 * | 12/2009 | Burazin et al. | 139/383 A |
| 7,625,461 | B2 * | 12/2009 | Burazin et al. | 162/116 |
| 2001/0001811 | A1 | 8/2001 | Mallol et al. | |
| 2002/0006005 | A1 | 5/2002 | Burazin et al. | |
| 2003/0010209 | A1 | 6/2003 | Allen et al. | |
| 2003/0015730 | A1 | 8/2003 | Burazin et al. | |
| 2004/0011854 | A1 | 6/2004 | Bakken et al. | |
| 2004/0126601 | A1 * | 7/2004 | Kramer et al. | 428/480 |
| 2006/0102302 | A1 | 5/2006 | Bakken et al. | |
| 2006/0137840 | A1 * | 6/2006 | Burazin et al. | 162/109 |
| 2006/0157210 | A1 | 7/2006 | Mullally et al. | |
| 2008/0073048 | A1 * | 3/2008 | Burazin et al. | 162/117 |
| 2009/0255640 | A1 * | 10/2009 | Morin et al. | 162/109 |
| 2010/0038044 | A1 * | 2/2010 | Burazin et al. | 162/116 |
| 2010/0059189 | A1 * | 3/2010 | Burazin et al. | 162/116 |
| 2010/0310845 | A1 * | 12/2010 | Bond et al. | 428/219 |

FOREIGN PATENT DOCUMENTS

| | | |
|---|---|---|
| EP | 1 122 360 A1 | 8/2001 |
| WO | WO 96/00814 | 1/1996 |
| WO | WO 96/35018 | 11/1996 |
| WO | WO 99/39050 | 8/1999 |
| WO | WO 2004/061219 | 7/2004 |
| WO | WO 2005/040494 | 5/2005 |

* cited by examiner

*Primary Examiner* — José A Fortuna
(74) *Attorney, Agent, or Firm* — Michael J. Sullivan

(57) ABSTRACT

Textured non-woven webs, papermaking fabrics and tissue sheets made using the textured papermaking fabrics can contain design elements set in highlight areas which make the design elements more visible.

12 Claims, 14 Drawing Sheets

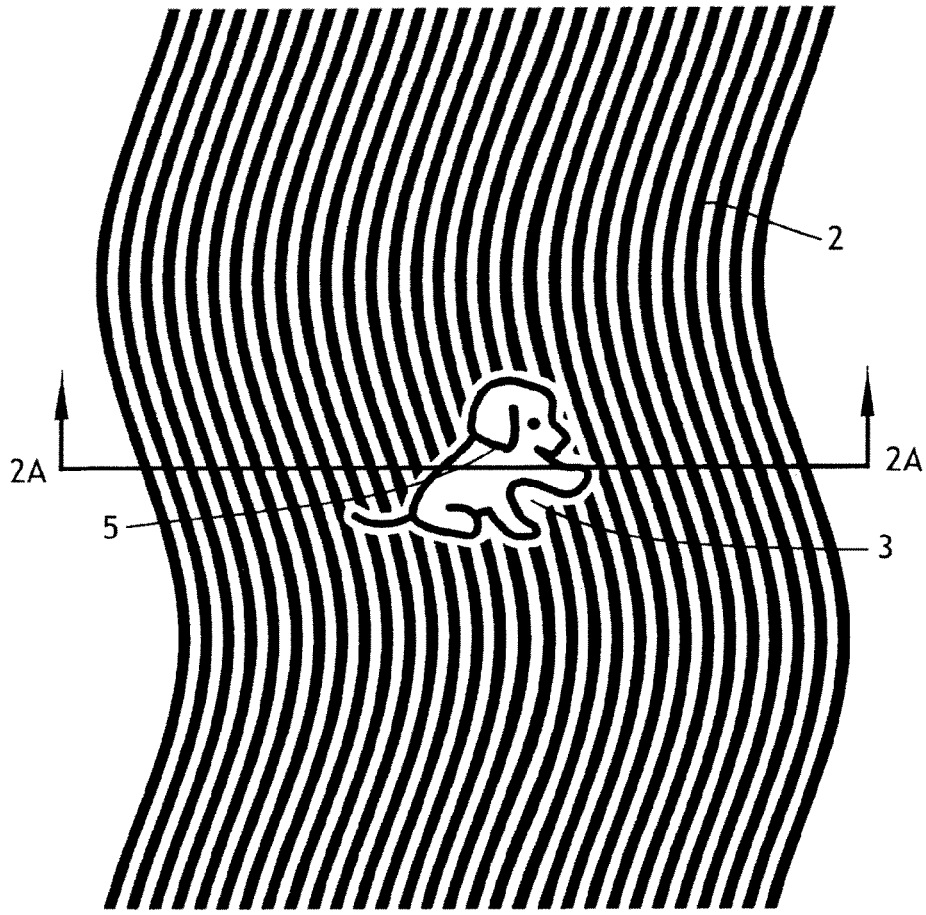
FIG. 2
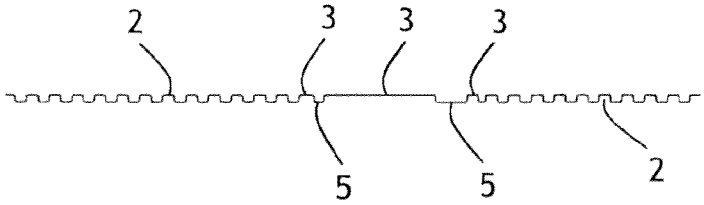
FIG. 2A
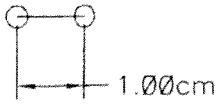

METHOD OF MAKING TEXTURED TISSUE SHEETS HAVING HIGHLIGHTED DESIGNS

This application is a divisional of U.S. Ser. No. 11/021,149 filed on Dec. 23, 2004 now U.S. Pat. No. 7,624,765. The entirety of U.S. Ser. No. 11/021,149 is hereby incorporated by reference.

BACKGROUND OF THE INVENTION

Throughdrying is a well known method of drying tissue sheets, such as those useful for facial tissue, bath tissue, paper towels and the like. In general, the method involves supporting a wet web on a throughdrying fabric and passing hot air through the web/fabric structure to dry the web with minimal compaction. Throughdrying fabrics have evolved into more three-dimensional structures in order to provide texture and bulk to the tissue sheet, which is often perceived as advantageous by consumers. Examples of such relatively three-dimensional throughdrying fabrics are disclosed, for example, in U.S. Pat. No. 5,429,686 to Chiu et al., U.S. Pat. No. 5,672,248 to Wendt et al., and U.S. Pat. No. 6,398,910 B1 to Burazin et al., all of which are hereby incorporated by reference. More recently, reformable papermaking fabrics, including throughdrying fabrics, have been developed in which the surface contour of a fabric can be altered to change its characteristics without changing fabrics on the papermaking machine. Such fabrics and methods of making them are disclosed in U.S. Pat. No. 7,141,142 entitled "Method of Making Paper Using Reformable Fabrics issued Nov. 28, 2006 to Burazin et al., herein incorporated by reference.

Although such three-dimensional throughdrying fabrics have many advantages, the texture imparted to the dried tissue sheet can detract from the visibility of any decorative elements which may also be imparted to the tissue sheet. Therefore there is a need for a throughdrying fabric that can impart texture to the tissue sheet while also imparting distinctive design elements as well.

SUMMARY OF THE INVENTION

It has now been discovered that tissue sheets can be made by using a papermaking fabric, such as an air-laid forming fabric or throughdrying fabric, having a three-dimensional topography with "highlight areas" that surround or otherwise outline "design elements". The highlight areas are imparted to the resulting tissue sheets such that the design elements are more clearly visible. In addition, the presence of the highlight areas enhances roll bulk for tissue products sold in roll form and increases the bulk of multi-ply tissue products by reducing nesting between adjacent plies.

Hence in one aspect, the invention resides in a tissue sheet having a textured background surface (hereinafter defined) which contains a highlight area (hereinafter defined) surrounding a design element (hereinafter defined).

In another aspect, the invention resides in a papermaking fabric, particularly a throughdrying fabric, having a sheet-contacting textured background surface which contains a highlight area surrounding a design element.

In another aspect, the invention resides in a method of modifying the surface of a non-woven web, particularly for the purpose of making a non-woven papermaking fabric, comprising: (a) providing a pattern roll having a textured background surface containing a highlight area surrounding a design element; (b) contacting the textured surface of the pattern roll with a thermoplastic non-woven web; (c) conforming the non-woven web to the textured surface of the pattern roll by drawing and/or blowing hot air through the non-woven web; and (d) cooling the resulting textured non-woven web.

In another aspect, the invention resides in a method of making a tissue sheet comprising: (a) depositing an aqueous suspension of papermaking fibers onto a forming fabric, thereby forming a wet tissue web; (b) transferring the wet tissue web to a papermaking fabric having a textured background sheet-contacting surface containing a highlight area surrounding a design element; and (c) drying the wet tissue web.

In another aspect, the invention resides in a method of forming an air-laid web comprising depositing a pneumatic suspension of fibers onto a papermaking fabric having a textured background surface containing a highlight area surrounding a design element.

In another aspect, the invention resides in a vacuum roll covered with a woven metal wire mesh fabric embossed with a highlight area surrounding a design element.

As used herein, the term "tissue sheet" means a low density paper sheet, such as sheets used for facial tissue, bath tissue, paper towels, table napkins and the like. Such sheets are characterized by a bulk of about 4 cubic centimeters or greater per gram as measured under a load of about 90 grams per square inch by conventional methods.

As used herein, the term "papermaking fabric" means any fabric or belt used for making a tissue sheet, either by a wet-laid process or an air-laid process. The papermaking fabrics of this invention can be woven fabrics or non-woven belts. Specific papermaking fabrics within the scope of this invention include wet-laid throughdrying fabrics and air-laid forming fabrics.

As used herein, the term "non-woven web" is a general term which includes any web or sheet comprising a non-woven layer of fibers. Non-woven webs can be a continuous length of non-woven material, laminated strips of non-woven material, or a "non-woven belt". For purposes herein, a "non-woven belt" refers to non-woven material which is in the form of a continuous loop or can be formed into a continuous loop, for example, by virtue of a seam. Non-woven belts, such as those comprising spiral-laminated non-woven webs, are particularly suitable for use in accordance with this invention.

As used herein, a "pattern roll" is any roll suitable for transferring its surface texture pattern to a non-woven web, either via heat and/or pressure (embossing or through air molding). Advantageously, pattern rolls can be air-permeable vacuum rolls covered with an embossed woven metal wire mesh fabric having the appropriate pattern and texture. Alternatively, the pattern roll can be a drilled roll which is engraved with a suitable surface pattern. Alternatively, the pattern roll can be an embossing roll. If the pattern roll is an embossing roll, it can be heated to soften the web or fabric being modified.

As used herein, the term "textured background surface" means a background surface having a three-dimensional topography with z-directional elevation differences of about 0.2 millimeter or greater. The topography can be regular or irregular. The background surface is the overall predominant surface of the sheet, fabric or other surface, excluding the portions of the surface occupied by the highlight areas and design elements. Suitable textured background surfaces include surfaces generally having alternating ridges and valleys or bumps and depressions. Since the texture of the background surface of a tissue sheet generally corresponds to the negative image of the background surface of the throughdrying fabric on which it is dried, or the air-laid forming fabric on which it is formed, the term "textured background surface"

applies to a tissue sheet, a papermaking fabric or any forming surface. For woven papermaking fabrics, the textured background surface of the fabric is provided by the general weave pattern. For non-woven papermaking fabrics, the textured background surface is provided by the molding or embossing pattern molded or embossed into the non-woven belt. For the tissue sheet or non-woven web product, the textured background surface can also be embossed.

As used herein, the term "surface plane of the textured background surface" means the plane formed by the highest points of the textured background surface.

As used herein, the term "design element" means a decorative figure, icon or shape such as a flower, heart, puppy, logo, trademark, word(s) and the like. The design element can be formed by raised areas, depressed areas or a combination of raised and depressed areas within the highlight area which give the design element a topography that distinguishes the design element from the surrounding highlight area. These raised and/or depressed areas can suitably be one or more curvilinear segments or other shapes. For the tissue sheet or non-woven web product, the design element can be the same or different color as the textured background surface or highlight area.

As used herein, the term "highlight area" means a surface area that either has substantially less surface texture than the surrounding background surface area, or has a texture that is substantially different in character than the surrounding background surface area, or has no texture, so that the design elements are easily distinguishable by the user of the tissue sheet or product containing the non-woven web. It can be particularly advantageous for the highlight areas to be "flat", meaning they have substantially no elevational differences or few elevational differences in order to enable the design elements to be easily seen. Suitably, such flat areas have z-directional elevation differences of about 0.5 millimeter or less. However, as stated above, the highlight areas alternatively can be textured, provided they have a texture that is different in character than the surrounding textured background surface area. Specific examples include, without limitation, a textured background surface area having substantially machine direction ridges and valleys, while the highlight areas comprise relatively flat regions, cross-machine direction ridges or lines, concentric circles or a series of dots. The highlight area can be raised above the mid-plane of the textured background surface, or it can be depressed below the mid-plane of the textured background surface, or it can be at the same level as the mid-plane of the textured background surface. In each case, the design element can be raised above the surface of the highlight area or depressed below the surface of the highlight area. For tissue sheets or non-woven webs, the highlight area can be of the same or different color as the textured background surface or design element, if present.

As used herein, the term "surface plane of the highlight area" means the plane formed by the highest points of the highlight area.

The area of the highlight area largely depends on the area of the design element. In general, the area of the highlight area can be about 3 square centimeters or greater, more specifically from about 3 to about 1200 square centimeters, more specifically from about 3 to about 150 square centimeters, more specifically from about 3 to about 18 square centimeters, and still more specifically from about 5 to about 10 square centimeters. The highlight area can substantially be in the shape of the periphery of the design element or it can be substantially different in shape than the periphery of the design element. The shape can be regular or irregular. Specific regular shapes include, without limitation, shapes that are substantially circular, square, triangular, rectangular, rhomboid or otherwise polygonal or the like. For most applications, the highlight areas will be self-contained and substantially well-defined, although in instances with multiple highlight areas the highlight areas may be interconnected if desired. For most applications, the spacing of the highlight areas (center-to-center) will be about 24 inches or less, more specifically about 6 inches or less, more specifically from about 1 to about 6 inches, and still more specifically from about 1 to about 3 inches. For many design elements, the area of the highlight areas, which includes the area occupied by the design element, will be from about 125 to about 600 percent of the area of the design element, more specifically from about 125 to about 300 percent, more specifically from about 125 to about 200 percent of the area of the design element. (The area of the design element is the surface area within a continuous line drawn around the periphery of the design element as a whole.

The means for creating the highlight areas and the design elements on the papermaking fabric depends on the nature of the papermaking fabric. Air-permeable highlight areas and design elements are particularly suitable for throughdrying fabrics. For example, for woven fabrics, an air-permeable texture-modifying material can be added to the sheet- or web-contacting surface of the woven fabric where the highlight areas are desired by filling in low areas of the woven topography with the air-permeable material, or even further building the material above the high points of the fabric as well, to create a relatively flat highlight area at the top level plane of the textured fabric or above it. Suitable air-permeable materials include non-woven fibers and open-celled foam materials. Thereafter, the design elements can be created by extruding a plastic material on top of the highlight areas in the form of the desired design element. Alternatively, the design elements can be woven or embroidered, stitched or embossed. Alternatively, the design elements can recessed within the highlight area and be created by selectively removing portions of the highlight area by cutting, embossing or grinding. In addition, the highlight areas can be created by sanding, grinding, or embossing selected raised areas of the woven fabric.

On the other hand, non-woven fabrics and woven fabrics having a non-woven web-contacting surface layer particularly lend themselves to being thermomechanically modified to provide the desired textured background surface, highlight areas and design elements within the highlight areas all in one step, such as by being through-air-molded by passing hot air through the fabric while the fabric is in contact with a pattern roll or other molding surface. Alternatively, the non-woven fabrics may be passed through a hot embossing nip to reconfigure the non-woven fibers or fiber layer. The use of a vacuum roll covered with an embossed woven metal wire mesh fabric is particularly suitable for through-air-molding the non-woven material into the desired surface pattern. These embossed woven metal wire mesh fabrics are substantially similar to embossed woven metal wire mesh fabrics used to cover dandy rolls, which are well known in the papermaking art for imparting watermarks to paper sheets. Non-woven webs can be through-air-molded to create papermaking fabrics with air-permeable background texture surfaces, highlight areas, and design elements, which are particularly suitable for throughdrying tissue.

In developing the various products and methods of this invention, it has also been determined that tissues, non-woven webs and papermaking fabrics can benefit by having highlight areas, even without design elements. These highlight areas can serve to build bulk in multi-ply products or roll products and can also provide attractive products in their own right.

Suitable well known methods of making non-woven base webs for purposes of this invention include meltblowing and spunbonding. Generally described, the process for making spunbond non-woven webs includes extruding thermoplastic material through a spinneret and drawing the extruded material into filaments with a stream of high-velocity air to form a random web on a collecting surface. Such a method is referred to as melt spinning. On the other hand, meltblown non-woven webs are made by extruding a thermoplastic material through one or more dies, blowing a high-velocity stream of air past the extrusion dies to generate an air-conveyed melt-blown fiber curtain, and depositing the curtain of fibers onto a collecting surface to form a random non-woven web.

The presence of multi-component materials, such as bi-component fibers and filaments, in the non-woven base webs can be helpful in molding the surface structure. A bi-component non-woven web can be made from polymeric fibers or filaments including first and second polymeric components which remain distinct. The first and second components can be arranged in substantially distinct zones across the cross-section of the filaments and extend continuously along the length of the filaments. Suitable embodiments include concentric or asymmetrical sheath-core structures or side-by-side structures. Typically, one component exhibits different properties than the other so that the filaments exhibit properties of the two components. For example, one component may be polypropylene, which is relatively strong, and the other component may be polyethylene, which is relatively soft. The end result is a strong, yet soft, non-woven web. Accordingly, bi-component structures can be selected depending on the needs of the non-woven material or, if layered, the layers of the non-woven material of the non-woven papermaking fabric under consideration. Sheath-core filaments with a thermoplastic sheath can be particularly useful because heating and cooling of the non-woven material fuses the thermoplastic material of the sheath of one filament to another in order to better lock the molded structure in place. Likewise, a first portion of fibers in the non-woven material can be thermoplastic with a lower melting point than a second portion of fibers in the non-woven material, such that the first portion of fibers can more easily melt and fuse the second portion of fibers together in the molded shape. Methods for making bi-component non-woven webs are well known in the art and are disclosed in patents such as: Reissue No. 30,955 of U.S. Pat. No. 4,068,036, issued on Jan. 10, 1978 to Stanistreet; U.S. Pat. No. 3,423,266, issued on Jan. 21, 1969 to Davies et al.; and U.S. Pat. No. 3,595,731, issued on Jul. 27, 1971 to Davies et al., all of which are herein incorporated by reference.

BRIEF DESCRIPTION OF THE DRAWINGS

FIGS. 1A and 1B, is a plan view drawing of a papermaking fabric in accordance with this invention, illustrating the sheet-contacting surface comprising a sinusoidal textured background surface and circular highlight areas surrounding a puppy design element. FIG. 1 and the following figures, unless otherwise stated, apply equally to paper sheets as well as papermaking fabrics.

FIG. 1A is a cross-sectional view of the papermaking fabric of FIG. 1, taken along line 1A-1A, further illustrating the texture of the sheet-contacting textured background surface.

FIG. 1B is a cross-sectional view of the papermaking fabric of FIG. 1, taken along line 1B-1B, illustrating the elevational difference between the textured background surface of the fabric and the highlight areas, as well as the elevational difference between the flat highlight areas and the design element components.

FIG. 2, which includes FIG. 2A, is a plan view drawing of an alternative embodiment of a papermaking fabric, similar to that of FIG. 1, except illustrating a single highlight area and design element wherein the highlight area has a shape that is substantially similar to that of the periphery of the design element.

DETAILED DESCRIPTION OF THE DRAWINGS

Unless otherwise stated, like reference numbers in the various figures represent the same features.

Figure 1:
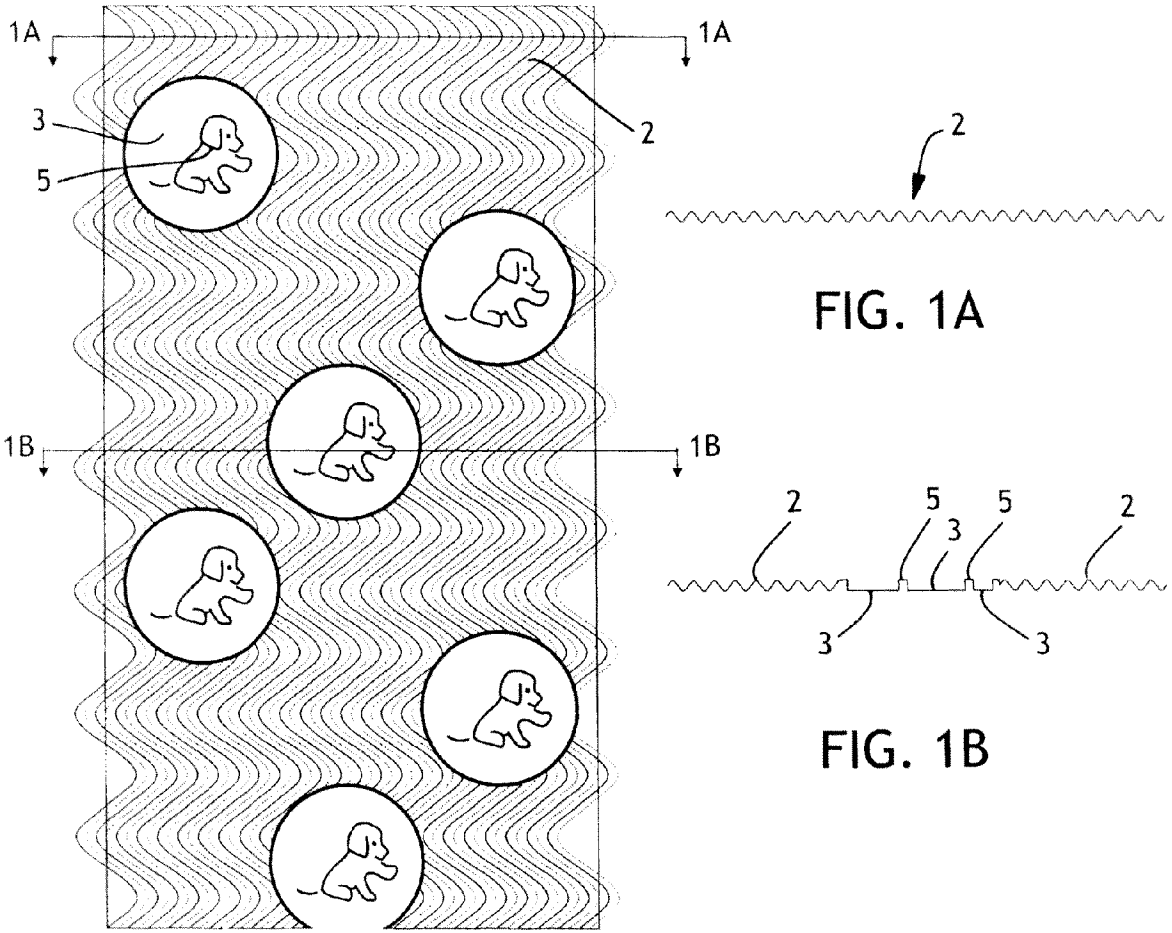
FIG. 1, which includes

Referring to FIG. 1, the invention will be further described in greater detail. Shown is a schematic plan view of the sheet-contacting surface of a non-woven papermaking fabric in accordance with this invention having a textured background surface 2 consisting of alternating sinusoidal peaks (solid lines) and valleys (dotted lines). Interspersed within the background surface are six circular highlight areas 3, each containing a puppy design element 5 defined by curvilinear lines for the outline of the body and tail, and a dot for an eye. In this embodiment, the curvilinear lines of the design element are raised areas.

FIG. 1A is a schematic cross-section taken along line A-A of FIG. 1, further illustrating the sinusoidal undulations of the textured background surface of the papermaking fabric of FIG. 1.

FIG. 1B is a schematic cross-section taken along line B-B of FIG. 1, illustrating the elevational and texture differences between the textured background surface, the highlight area and the components of the design element. In this case, the surface plane of the flat highlight area is below the mid-plane of the textured background surface and the design element is raised above the surface plane of the highlight area.

FIG. 2, which includes FIG. 2A, is a plan view drawing of an alternative embodiment of a papermaking fabric, similar to that of FIG. 1, except illustrating a single puppy design element 5 and flat highlight area 3 wherein the highlight area has a shape that is substantially similar to that of the periphery of the design element. The textured background surface 2 has a sinusoidal pattern of alternating raised lines (light) and depressed lines (dark). In this embodiment, the highlight area is above the mid-plane of the textured background surface and even with the surface plane of the textured background surface. The design element is below the surface plane of the highlight area and below the mid-plane of the textured background surface.

Figure 3:
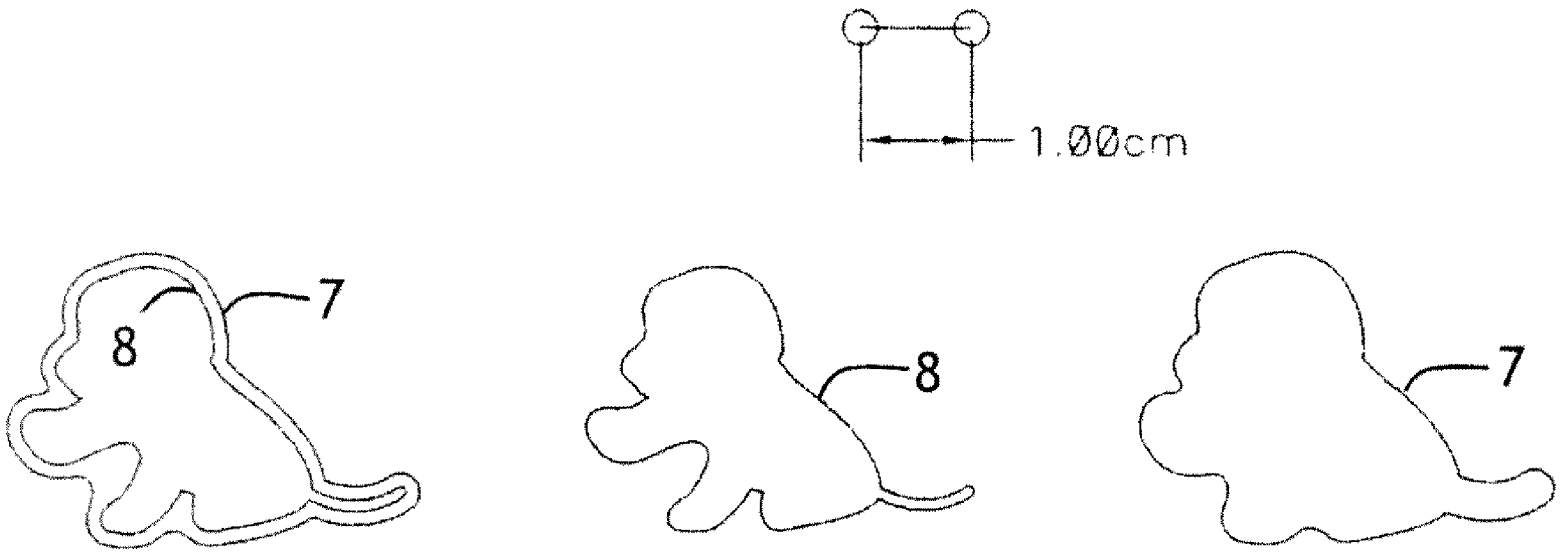
FIG. 3 is a drawing of the periphery of the puppy design element and the periphery of highlight area of FIG. 2, more clearly illustrating their relative areas.

FIG. 3 contains three drawings showing the periphery 7 of the highlight area and the periphery 8 of the puppy design element of FIG. 2, more clearly illustrating their relative areas. The two peripheries are superimposed in the remaining figure. In this embodiment, the area of the highlight area is about 144 percent of the area of the design element.

Figure 4:
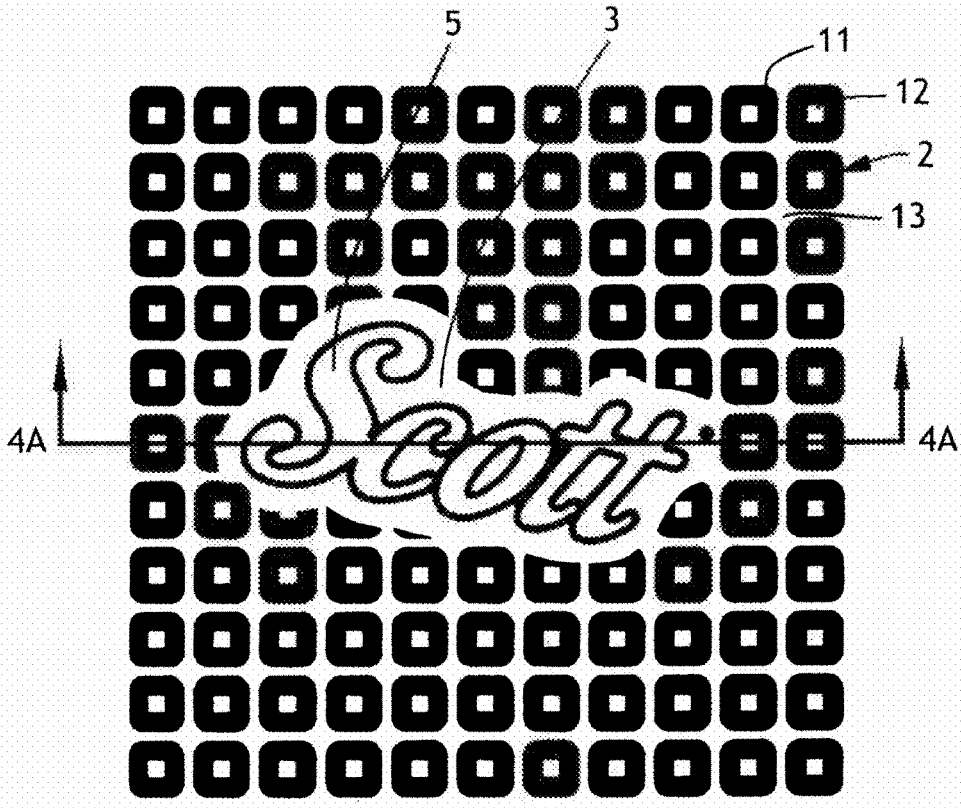
FIG. 4 is a plan view drawing of another papermaking fabric in accordance with this invention, similar to FIGS. 1 and 2, illustrating a different textured background surface, highlight area and design element (SCOTT®).
Figure 4A:
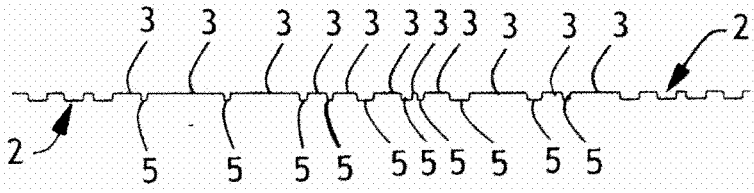
Figure 4A:
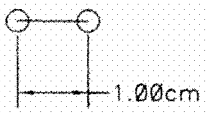

FIG. 4 is a plan view drawing of another papermaking fabric in accordance with this invention, similar to FIGS. 1 and 2, illustrating a different textured background surface, highlight area and design element (SCOTT®). Specifically, the textured background surface comprises an array of generally square depressions 11 (dark) with a raised square 12 (light) in the middle. The continuous area 13 between the squares 11 is at the same level as the highlight area 3.

Figure 5:
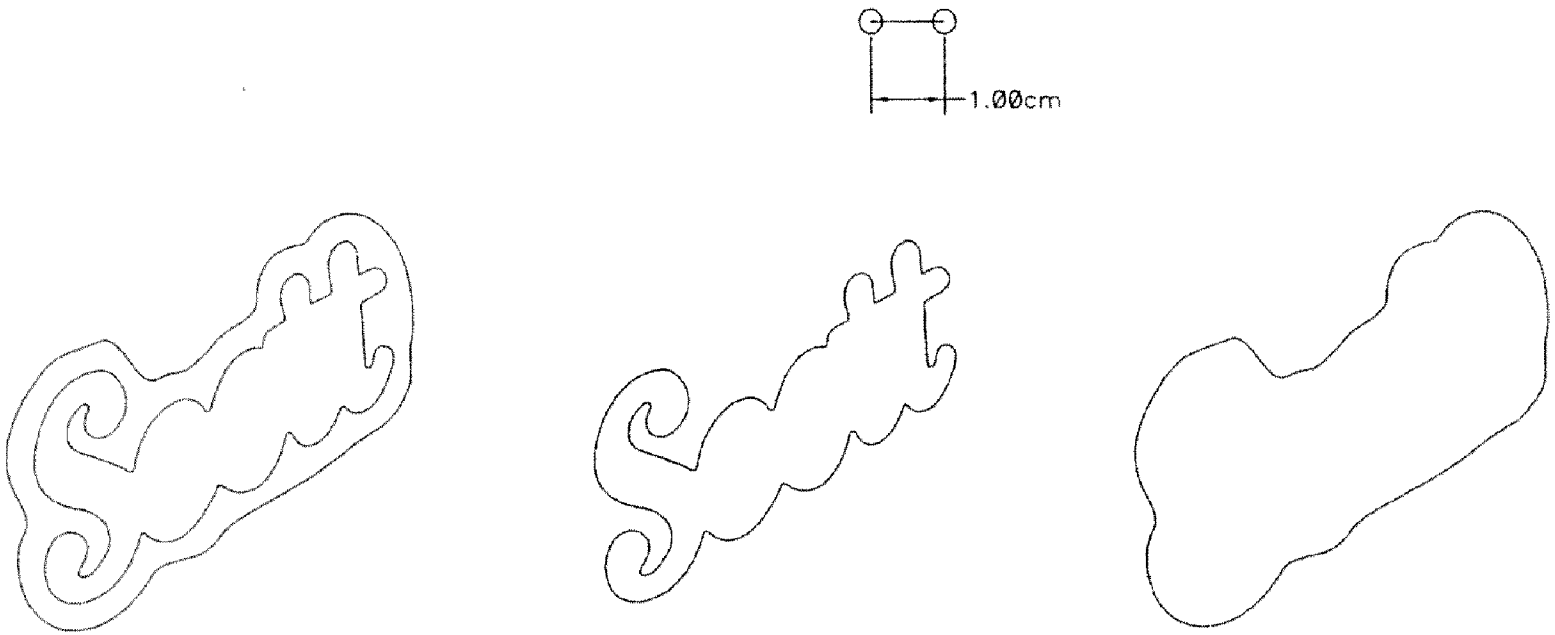
FIG. 5 is a drawing of the periphery of the SCOTT® design element and the periphery of highlight area of FIG. 4, more clearly illustrating their relative areas.

FIG. 5 contains three drawings showing the periphery 7 of the highlight area and the periphery 8 of the SCOTT® design element of FIG. 4. The two peripheries are superimposed in the remaining figure. In this embodiment, the area of the highlight area is about 190 percent of the area of the design element.

Figure 6:
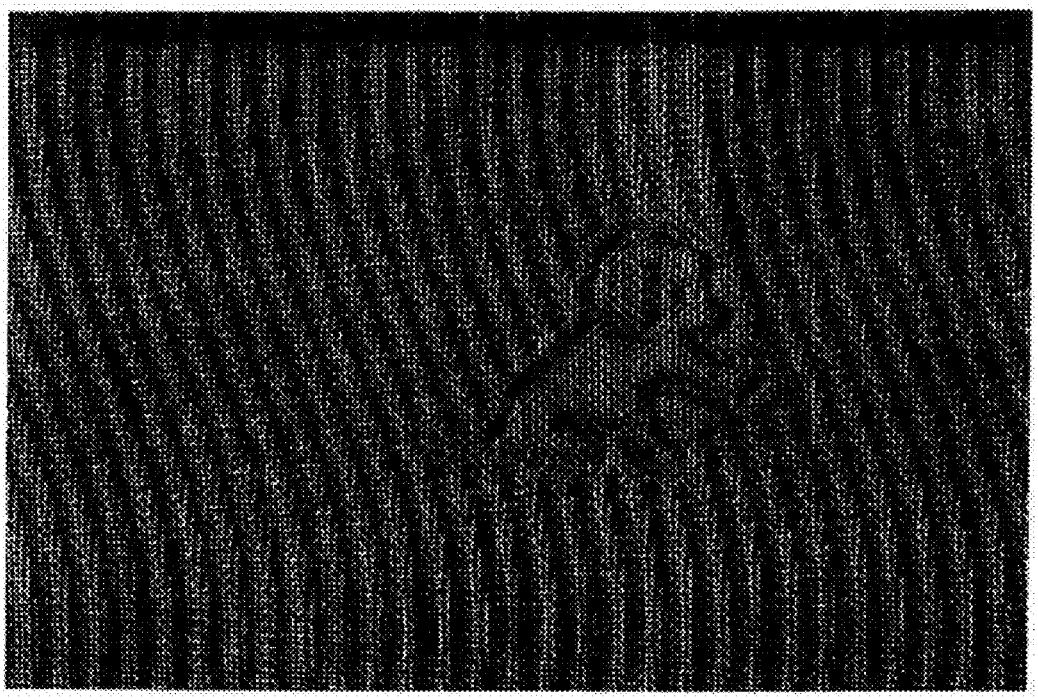
FIG. 6 is a photograph of a woven metal wire mesh fabric in accordance with this invention which has been embossed to provide a textured background surface, highlight area, and design element (puppy) substantially as shown in FIG. 2. For this photograph and those that follow, lighting was provided from the side, so that depressed areas are dark and raised areas are light. The space between each of the vertical lines in the scale at the top of the photograph (and the following photographs) represents one millimeter. Woven metal wire mesh fabrics of this type are commonly used as components of dandy roll covers.

FIG. 6 is a photograph of a woven metal wire mesh fabric in accordance with this invention which has been embossed to provide a textured background surface, a highlight area, and a design element (puppy) substantially as shown in FIG. 2. For this photograph and those that follow, lighting was provided from the side, so that depressed areas are dark and raised areas are light. The space between each of the vertical lines in the scale at the top of the photograph (and the following photographs) represents one millimeter. Woven metal wire mesh fabrics of this type are commonly used as components of dandy roll covers.

Figure 7:
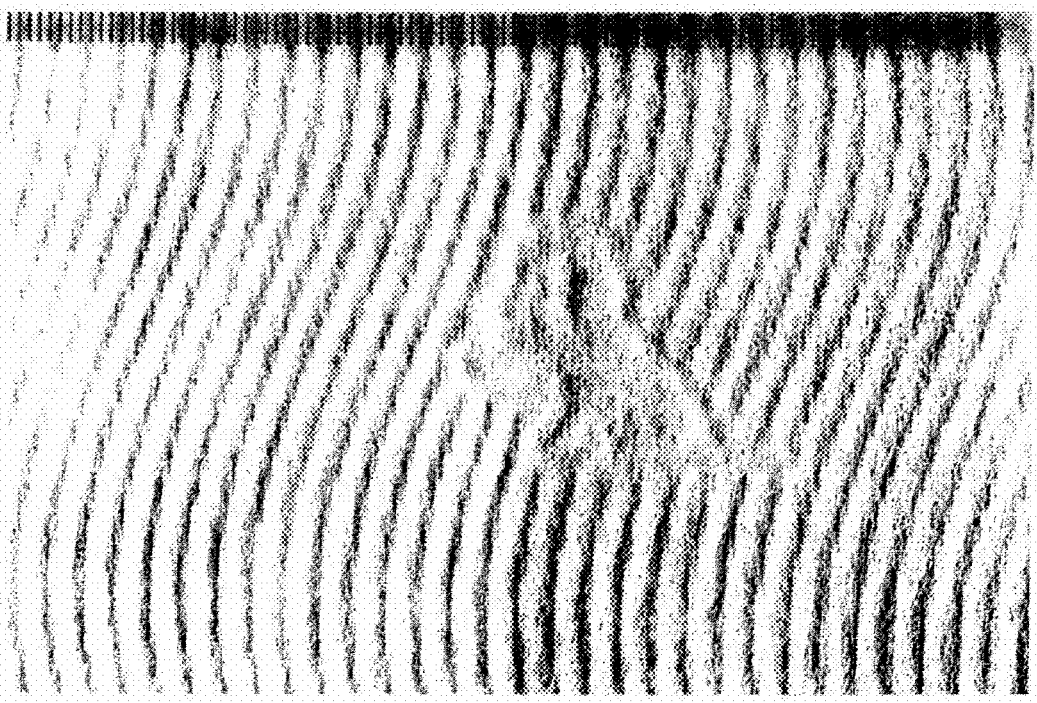
FIG. 7 is a photograph of a spunbond non-woven papermaking fabric made using a woven metal wire mesh fabric substantially as shown in FIG. 6 in accordance with the method of this invention.

FIG. 7 is a photograph of a spunbond non-woven papermaking fabric made using a woven metal wire mesh fabric substantially as shown in FIG. 6 in accordance with the method of this invention.

Figure 8:
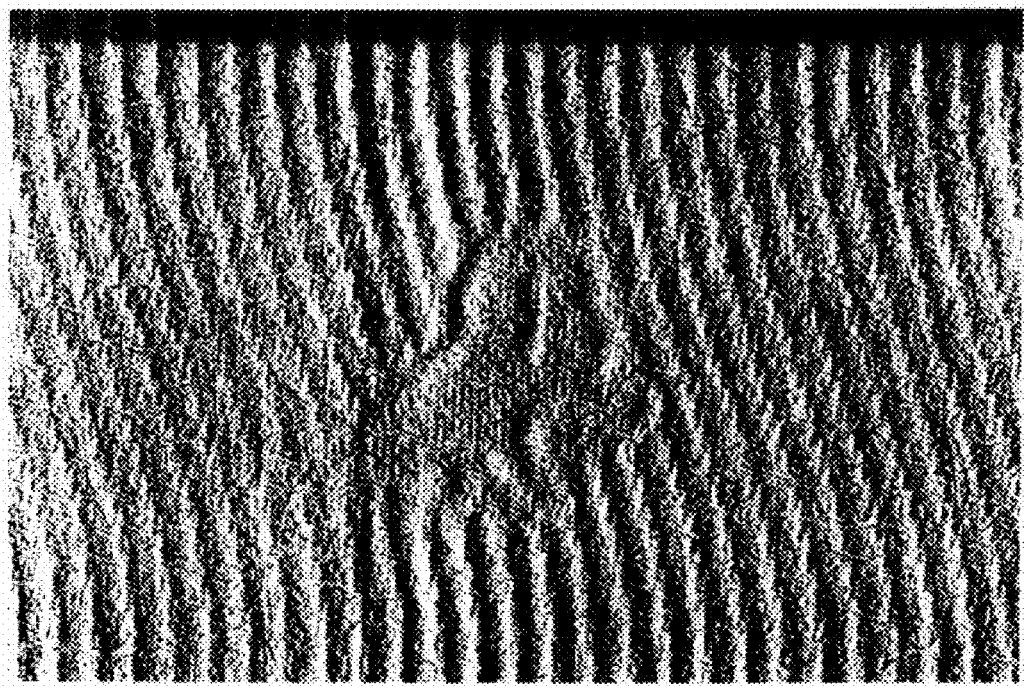
FIG. 8 is a photograph of a tissue sheet in accordance with this invention that was made using the throughdrying fabric of FIG. 7.

FIG. 8 is a photograph of a tissue sheet in accordance with this invention that was made using the papermaking fabric of FIG. 7.

Figure 9:
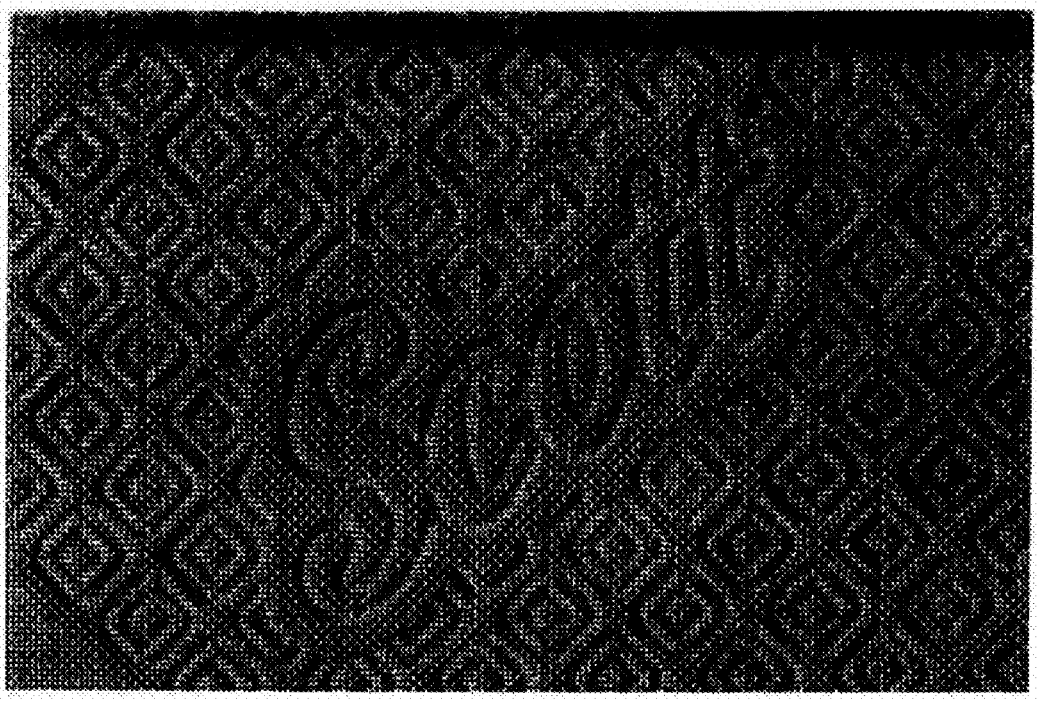
FIG. 9 is a photograph of another woven metal wire mesh fabric in accordance with this invention which has been embossed to provide a textured background surface, a highlight area, and a design element (the SCOTT® brand name) substantially as shown in FIG. 4.

FIG. 9 is a photograph of another woven metal wire mesh fabric in accordance with this invention which has been embossed to provide a textured background surface, a highlight area, and a design element (the SCOTT® brand name) substantially as shown in FIG. 4.

Figure 10:
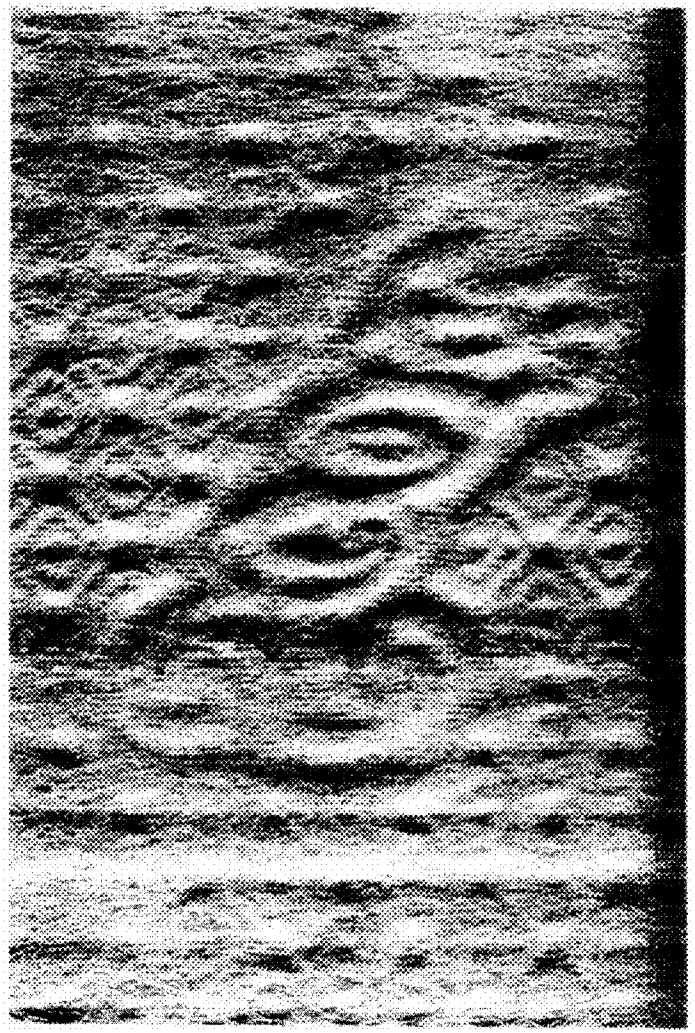
FIG. 10 is a photograph of a spunbond non-woven throughdrying fabric made using a woven metal wire mesh fabric substantially as shown in FIG. 9 in accordance with this invention.

FIG. 10 is a photograph of a spunbond non-woven papermaking fabric made using a woven metal wire mesh fabric substantially as shown in FIG. 9 in accordance with this invention.

Figure 11:
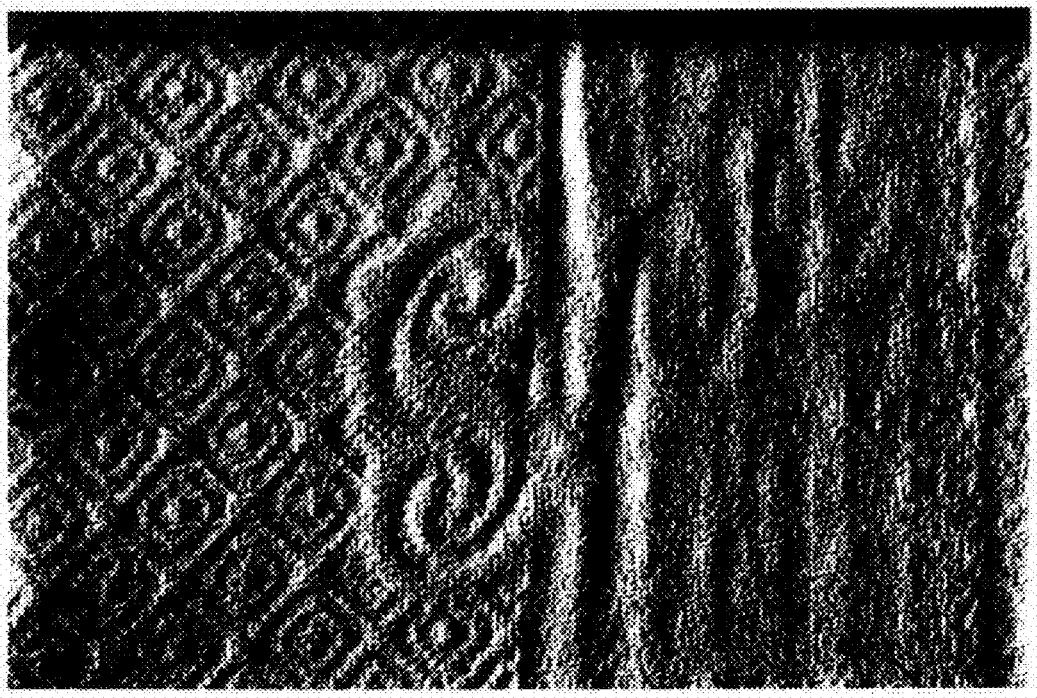
FIG. 11 is a photograph of a tissue sheet in accordance with this invention made using the throughdrying fabric of FIG. 10.

FIG. 11 is a photograph of a tissue sheet in accordance with this invention made using the papermaking fabric of FIG. 10.

Figure 12:
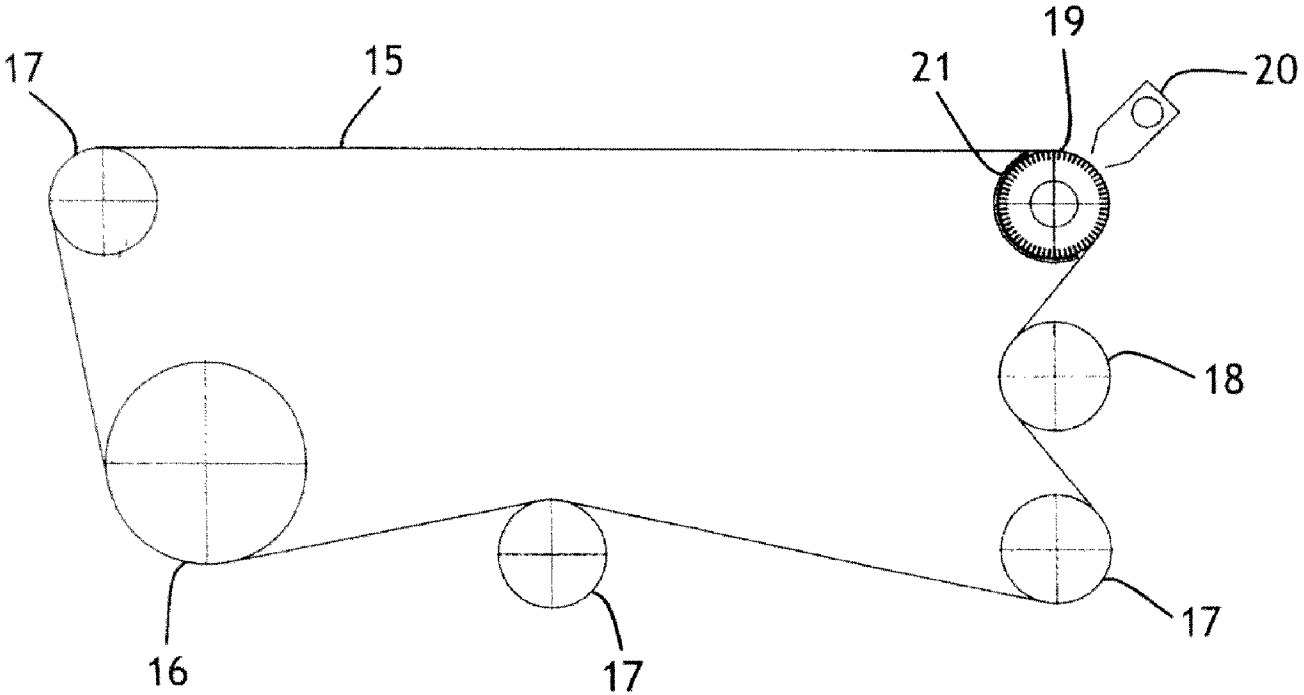
FIG. 12 is a schematic diagram of a method for making a non-woven papermaking fabric in accordance with this invention.

FIG. 12 is a schematic illustration of a method of making a papermaking fabric in accordance with this invention. Shown are the papermaking fabric 15, drive roll 16, guide rolls 17, tensioning roll 18, pattern roll 19, hot air knife or air plenum 20 and vacuum shield 21. The pattern roll is a vacuum roll covered with a woven metal wire mesh fabric, which has been modified with a selected design. A particularly suitable means of providing the desired design is to emboss the woven metal wire mesh fabric prior to attachment to the roll surface. In operation, the papermaking fabric 15 starts out as a plain non-woven web, non-woven laminated belt, or non-woven web laminated to a woven fabric backing. The non-woven web, the non-woven belt, or the non-woven web backed by a fabric, is passed over the pattern roll 19 and is conformed to the surface of the pattern roll using hot air and vacuum. The temperature of the hot air is such that it is sufficient to soften the non-woven fibers sufficiently for them to conform to the pattern roll surface with the aid of vacuum. As shown, the web is a continuous loop (belt), so that any given portion of the belt traverses the pattern roll only one time to complete the transformation. Thereafter, the resulting papermaking fabric is removed from the rolls.

Figure 13:
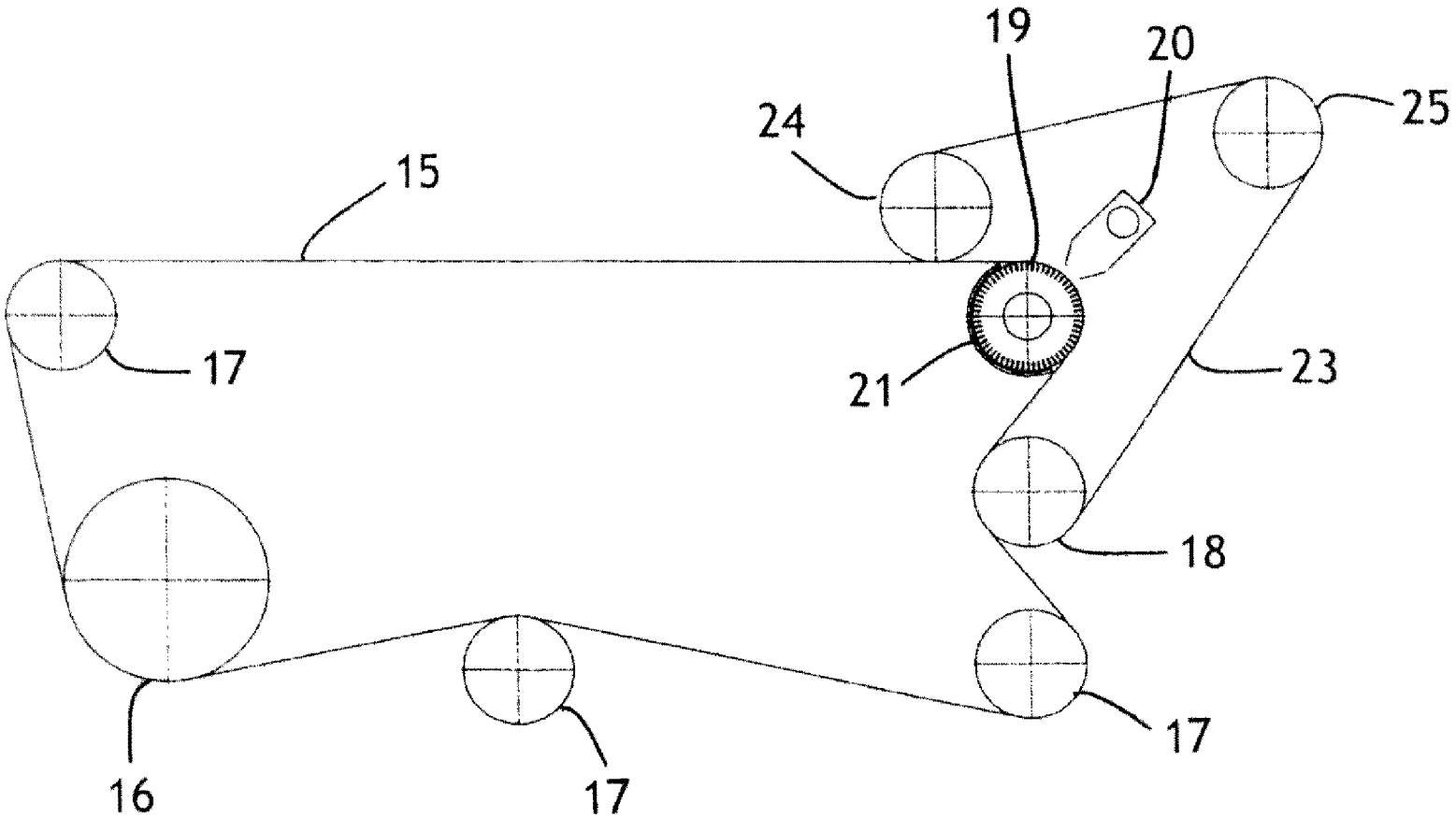
FIG. 13 is a schematic diagram of an alternative method for making a non-woven papermaking fabric in accordance with this invention.

FIG. 13 is a schematic illustration of a method of making a papermaking fabric as shown and described with respect to FIG. 12, but with an additional component comprising a pressure fabric 23 wrapped around rolls 18, 24 and 25. The pressure fabric serves to provide additional force to conform the non-woven belt to the surface contour of the pattern roll. It also allows a reduction in the tension of the fabric 15.

Figure 14:
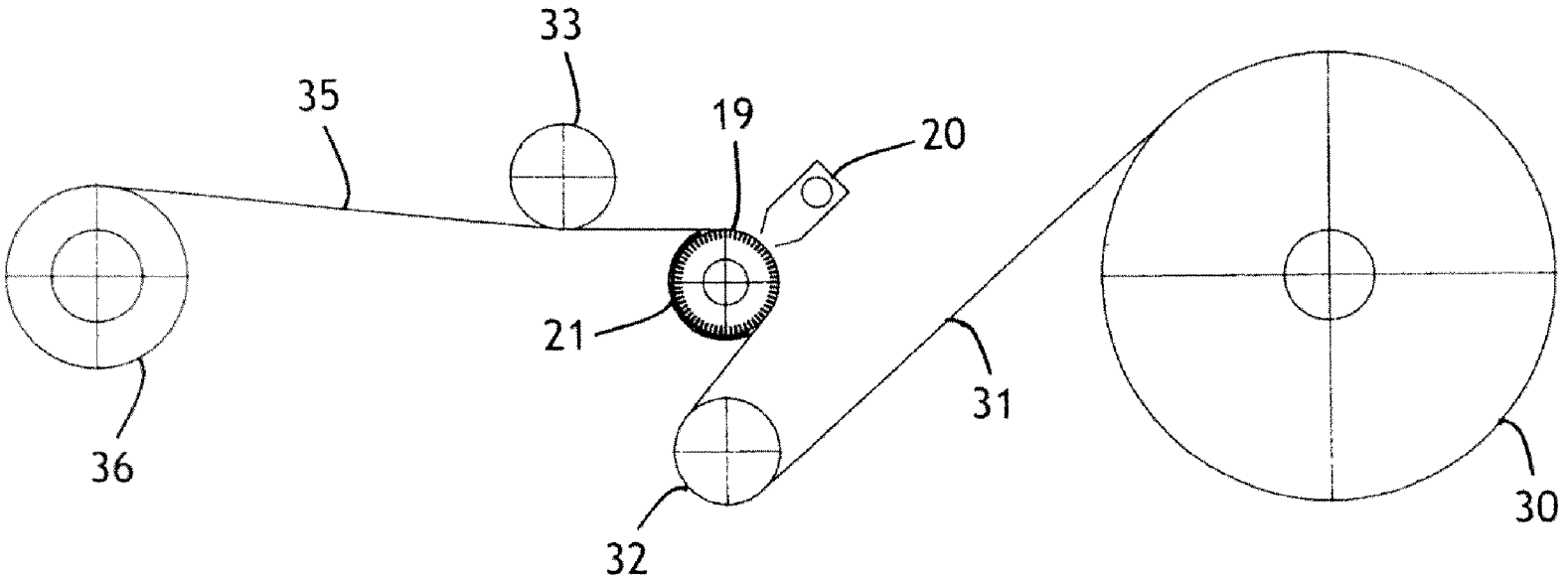
FIG. 14 is a schematic diagram of a method of making a non-woven web having a surface texture and/or design elements.

FIG. 14 illustrates an alternative method of making a modified non-woven web. Shown is a roll 30 of non-woven material being unwound. The non-woven web 31 is passed around guide rolls 32 and over pattern roll 19. Hot air is applied as described above to conform the non-woven web to the desired design on the pattern roll. The web tension can be controlled by differential speed between roll 30 and roll 36 and/or using tension roll 33. The resulting modified web 35 is wound into a roll 36. For making papermaking fabrics as described herein, the modified papermaking fabric material is thereafter unwound and spliced to the desired fabric loop size. However, this method can also be used to make non-woven web components for use in personal care products, such as diapers, for which the design imparted to the web by the pattern roll can be any design or texture and is not limited to design elements surrounded by highlight areas.

EXAMPLES

Example 1

In order to further illustrate the method of this invention, a flat, spiral wound, laminated non-woven belt was through-air-molded into a three-dimensional throughdrying fabric in accordance with this invention as described in connection with FIG. 12. The pattern roll had a textured background surface, highlight area, and puppy design element substantially as shown in FIG. 6. The three-dimensional sheet-contacting surface of the resulting throughdrying fabric is shown in FIG. 7. The throughdrying fabric was then used to produce a throughdried tissue basesheet in accordance with this invention as shown in FIG. 8.

More specifically, the non-woven belt comprised a spunbond web made from bi-component polymer fibers with a concentric sheath-core structure. The sheath material comprised Crystar® 5149 polyethylene terephthalate (PET) polyester resin (The DuPont Company, Old Hickory, Tenn.). The core material comprised HiPERTUF® 90000 polyethylene naphthalate (PEN) polyester resin (M&G Polymers USA LLC, Houston, Tex.). The sheath-to-core weight ratio was about 1:1. A bi-component spunbond non-woven web was made in a conventional manner using a forming head having 22 holes per 25.4 millimeters (mm) of face width, the holes having a diameter of 1.35 mm. The polymer was pre-dried overnight in polymer dryers at a temperature of about 160° C. The polymer was then extruded at a pack temperature of about 316° C. with a pack pressure of about 6.9 MPa for the core and about 4.1 MPa for the sheath. The spin line length was about 127 centimeters (cm). Quench air was provided at about 1.2 kilo Pascals (kPa) and a temperature of about 68° C. The fiber draw unit operated at a temperature of about 175° C. and a pressure of about 0.9 kPa. The forming height (height above the forming wire) was about 32 centimeters (cm). The forming wire speed was about 30 centimeters per second (cm/s). Bonding was achieved using a hot air knife operating at pressure of about 1.1 kPa and a temperature of about 177° C. about 25 mm above the forming wire. The resulting spunbond web had an average fiber diameter of about 35 microns and a basis weight of about 94 grams per square meter (gsm).

The spunbond web was trimmed from a width of about 43 cm to about 30 cm. The trimmed web was unwound, tensioned, spiral wound and laminated into a flat, spiral wound papermaking belt. Specifically, the spunbond web was laminated between a hot air knife and a vacuum transfer roll operating at a temperature of about 216° C. The web was unwound at about 2.0 cm/s, while the building belt was wound at about 2.5 cm/s (about 25 percent draw). The finished flat belt was about 9.3 meters in length and was trimmed to a width of about 56 cm. Due to the degree of overlap which occurred during spiral winding, the finished flat belt varied between three and four plies in thickness.

The flat spunbond non-woven papermaking belt was converted into a patterned non-woven throughdrying fabric by through-air-molding the flat belt on a pattern roll which was covered with woven metal wire mesh fabric and embossed with a pattern substantially as shown in FIG. 2 and FIG. 6. More specifically, the flat belt was through-air-molded using a speed of about 1.0 cm/s, a temperature of about 254° C. and a differential pressure of about 10 kPa. A photograph of the resulting non-woven throughdrying fabric is shown in FIG. 7.

The non-woven throughdrying fabric was then used to produce a throughdried tissue sheet in accordance with this invention using an uncreped throughdrying tissue making process. In particular, a fiber furnish comprising bleached northern softwood kraft fiber was fed to a Fourdrinier former using a Voith Fabrics 2164-B33 forming fabric (commercially available from Voith Fabrics in Raleigh, N.C.). Kymene® 557 LX was added to the machine chests at a concentration of about 8 kilograms per metric ton of fiber. The speed of the forming fabric was about 0.32 meters per second (m/s). The newly-formed wet tissue web was then dewatered to a consistency of about 30 percent using vacuum suction from below the forming fabric before being transferred to a transfer fabric, which was traveling at about 0.25 m/s (about 28 percent rush transfer). The transfer fabric was a Voith Fabrics t1207-6 fabric. A vacuum shoe pulling about 54 kPa of vacuum was used to transfer the wet tissue web to the transfer fabric.

The wet tissue web was then transferred to the non-woven throughdrying fabric described above, which was traveling at a speed of about 0.25 m/s. A vacuum shoe pulling about 54 kPa of vacuum was used to transfer the wet tissue web to the non-woven throughdrying fabric. The wet tissue web was carried over a throughdryer operating at an air supply temperature of about 166° C. and dried to final dryness of at least 99 percent consistency. The resulting uncreped throughdried tissue basesheet had an unconditioned basis weight of about 36 grams per square meter. A photograph of the resulting uncreped throughdried tissue basesheet is shown in FIG. 8.

Example 2

In order to further illustrate the method of this invention, a tissue sheet was made as described in Example 1, except that a different three-dimensional pattern was through-air-molded into another flat, spiral wound, laminated non-woven papermaking belt in accordance with this invention as described in connection with FIG. 12. The three-dimensional pattern is substantially as shown in FIG. 4 and FIG. 9. The resulting three-dimensional sheet-contacting surface of the molded non-woven throughdrying fabric is shown in FIG. 10. The fabric was used to produce a molded uncreped throughdried tissue basesheet as shown in FIG. 11.

It will be appreciated that the foregoing description and examples, given for purposes of illustration, are not to be construed as limiting the scope of the invention, which is defined by the following claims and all equivalents thereto.

We claim:

1. A method of making a tissue sheet comprising:

(a) depositing an aqueous suspension of papermaking fibers onto a forming fabric, thereby forming a wet tissue web;

(b) transferring the wet tissue web to a woven throughdrying papermaking fabric having a three-dimensional weave pattern which exhibits a texture defined by z-directional elevational differences of about 0.2 millimeter or greater, and a highlight area, the highlight area being surrounded by the three-dimensional weave pattern of the fabric and having a texture that is less than the texture of the weave pattern, wherein the weave pattern provides a textured background surface which is the overall predominant sheet-contacting surface of the fabric;

(c) drying the wet tissue web.

2. The method of claim 1 wherein the highlight area of the papermaking fabric contains a design element.

3. The method of claim 2 wherein the design element is raised above the surface plane of the highlight area.

4. The method of claim 2 wherein the design element is depressed below the surface plane of the highlight area.

5. The method of claim 2 wherein the design element is air-permeable.

6. The method of claim 2 wherein the design element is higher than the surface plane of the textured background surface.

7. The method of claim 2 wherein the design element comprises an extruded material on top of the highlight area.

8. The method of claim 2 wherein the three-dimensional weave pattern contains substantially machine direction ridges and valleys, the highlight areas are flat and the design elements comprise an extruded material on top of the highlight areas.

9. The method of claim 1 wherein the highlight area is air-permeable.

10. The method of claim 1 wherein the surface plane of the highlight area is higher than the surface plane of the textured background surface.

11. The method of claim 1 wherein the highlight areas are flat.

12. The method of claim 1 wherein the three-dimensional weave pattern contains substantially machine direction ridges and valleys and the highlight areas are flat.

* * * * *